United States Patent [19]

Barry

[11] Patent Number: 4,523,579

[45] Date of Patent: Jun. 18, 1985

[54] LIGHTWEIGHT BODY RESPIRATOR HAVING FLEXIBLE WALLS

[76] Inventor: Edward R. Barry, 46 Woodlawn Cir., Whitman, Mass. 02382

[21] Appl. No.: 507,806

[22] Filed: Jun. 24, 1983

[51] Int. Cl.[3] ..... A61H 31/00

[52] U.S. Cl. ..... 128/30.2

[58] Field of Search ..... 128/30, 30.2, 25 R, 128/1 B, 205.26, 202.12, 1 R

[56] References Cited

U.S. PATENT DOCUMENTS

| | | | |
|---|---|---|---|
| 2,227,847 | 1/1941 | Shoolman | 128/30.2 |
| 2,354,397 | 6/1944 | Miller | 128/30.2 |
| 2,543,426 | 2/1951 | Terhaar | 128/30 |
| 2,776,657 | 1/1957 | Batson et al. | 128/1 B |
| 2,827,043 | 3/1958 | Wallin | 128/30.2 |
| 3,889,670 | 6/1975 | Loveland et al. | 128/205.26 |
| 4,003,378 | 1/1977 | Pickering | 128/30 |
| 4,481,938 | 11/1984 | Lindley | 128/30 |

FOREIGN PATENT DOCUMENTS

| | | | |
|---|---|---|---|
| 522536 | 6/1940 | United Kingdom | 128/30.2 |

*Primary Examiner*—Henry J. Recla

*Attorney, Agent, or Firm*—Weingarten, Schurgin Gagnebin & Hayes

[57] ABSTRACT

A lightweight molded-thermoplastic housing having flexible walls provides a respirator cavity having an internal volume adapted to accept either the torso of an adult patient or the body of a child patient. The molded-thermoplastic housing includes a thermoplastic cover member having integral walls that is removably fastened by spring-loaded latches in air-tight sealing engagement to an integral thermoplastic base member. The integral thermoplastic cover member has an open rectangular bottom having a comparatively large area, a vertically-spaced planar top having a comparatively smaller area, four vertically inclined arcuate support ribs individually extending from the vertices of the open bottom to corresponding confronting vertices of the planar top, and four sloping flexible planar walls that join the open bottom to the planar top between adjacent ribs. The base member includes four upstanding sidewalls defining a conformal mattress receiving cavity. A neck receiving opening is provided on one end of the respirator. A waist/leg receiving opening is provided on the other end of the respirator. An elongated and flexible neck receiving adjustable collar is removably attached to the neck receiving opening for providing an air-tight seal between the neck of a patient and the respirator. An elongated and flexible girdle having left and right leg receiving adjustable collars is removably attached to the waist/leg receiving opening to provide an air-tight seal between the legs of the patient and the respirator. An air-tight patient access hatch is provided. An oscillating pressure pump is provided for controllably varying the cavity pressure thereby to respirate a patient.

18 Claims, 9 Drawing Figures

LIGHTWEIGHT BODY RESPIRATOR HAVING FLEXIBLE WALLS

FIELD OF THE INVENTION

This invention is directed to the field of surgery, and more particularly, to a novel lightweight body respirator having flexible walls.

BACKGROUND OF THE INVENTION

Electromechanical devices are commonly employed for respirating patients that are afflicted with one or more of various diseases that adversely affect their ability to breathe. A systematic program of night respiration, as reported in an article entitled, "Night Ventilation By Body Respirators For Patients In Chronic Respiratory Failure Due To Late Stage Duchenne Muscular Dystrophy" by Francis J. Curran, M.D., appearing at Volume 62, ARCH PHYS MED REHABIL, pp. 270–273 (June 1981), incorporated herein by reference, has been found to significantly improve the health of many such patients, and to materially delay the onset of debilitating complications. The utility of iron lung type devices used for such purposes is limited, among other things, by their considerable size, weight, and cost. Iron lungs are unaffordable by many, and are difficult to install in the home of a patient. After home installation, moveover, it is not practicably possible to move the device for providing away from home treatment. The utility of cuirass type devices used for such purposes is limited, among other things, by the necessity of customizing each cuirass to the body of a particular patient, and by the patient discomfort often occassioned by cuirass to body pressure points. In addition, pressure leaks typically necessitate repeated fittings and trials with each patient.

SUMMARY OF THE INVENTION

The novel lightweight body respirator having flexible walls of the present invention is readily capable of both in-the-home and away-from-home use by relatively untrained personnel, is expeditiously manufactured in a manner that costs considerably less than the heretofore known devices, can be used by both adults and children without requiring customized fitting, and is both efficient and comfortable. The body respirator of the present invention includes a lightweight, molded-thermoplastic housing having flexible walls that defines a respirator cavity having an internal volume adapted to accept either the torso of an adult patient or the body of a child patient. The molded-thermoplastic housing includes a thermoplastic cover member having integral walls that is removably fastened by spring-loaded latches in air-tight sealing engagement to an integral molded-thermoplastic base member. The integral thermoplastic cover member has a generally rectangular open bottom having a comparatively large area, a vertically-spaced generally rectangular and substantially planar top having a comparatively smaller area, four vertically inclined arcuate support ribs individually exending from the vertices of the open bottom to corresponding confronting vertices of the substantially planar top, and four sloping substantially planar flexible walls that join the open bottom to the substantially planar top between adjacent ribs. The thermoplastic integral base member includes four upstanding sidewalls defining a rectanguloid box having an open substantially rectangular top and a conformal mattress receiving cavity. A longitudinally extending flange having a generally semi-circular cross section is provided on one wall of the top member that is cooperative with a longitudinally extending flange having an arcuate cross-section provided on one of the upstanding sidewalls of the base member to provide a neck receiving opening on one end of the respirator. A longitudinally extending flange having a generally trapezoidal cross-section is provided on a confronting wall of the cover member that is cooperative with a longitudinally extending flange having a generally U-shaped cross-section on the adjacent sidewall of the base member to provide a leg receiving opening on the other end of the respirator. An elongated, flexible, and adjustable neck receiving collar is removably attached peripherally to the flanges defining the neck receiving opening for providing an air-tight seal between the neck of a patient and the respirator. An elongated and flexible girdle having left and right leg receiving adjustable collars is removably attached peripherally to the flanges defining the leg receiving opening to provide an air-tight seal between each of the legs of the patient and the respirator. A removably attachable and air-tight patient access hatch is provided centrally on the top surface of the cover member. Means disposed peripherally around the bottom of the cover member and the top of the upstanding walls of the base member are cooperative to provide an air-tight seal therebetween. An oscillating pressure pump is connected through one of the sidewalls of the respirator in communication with the respirator cavity for controllably varying the pressure therein and thereby to respirate the patient.

BRIEF DESCRIPTION OF THE DRAWINGS

Other advantages and features will become apparent as the invention becomes better understood by reference to the following exemplarly and non-limiting detailed description of the preferred embodiments, and to the drawings, wherein.

DETAILED DESCRIPTION OF THE PREFERRED EMBODIMENTS

Figure 1:
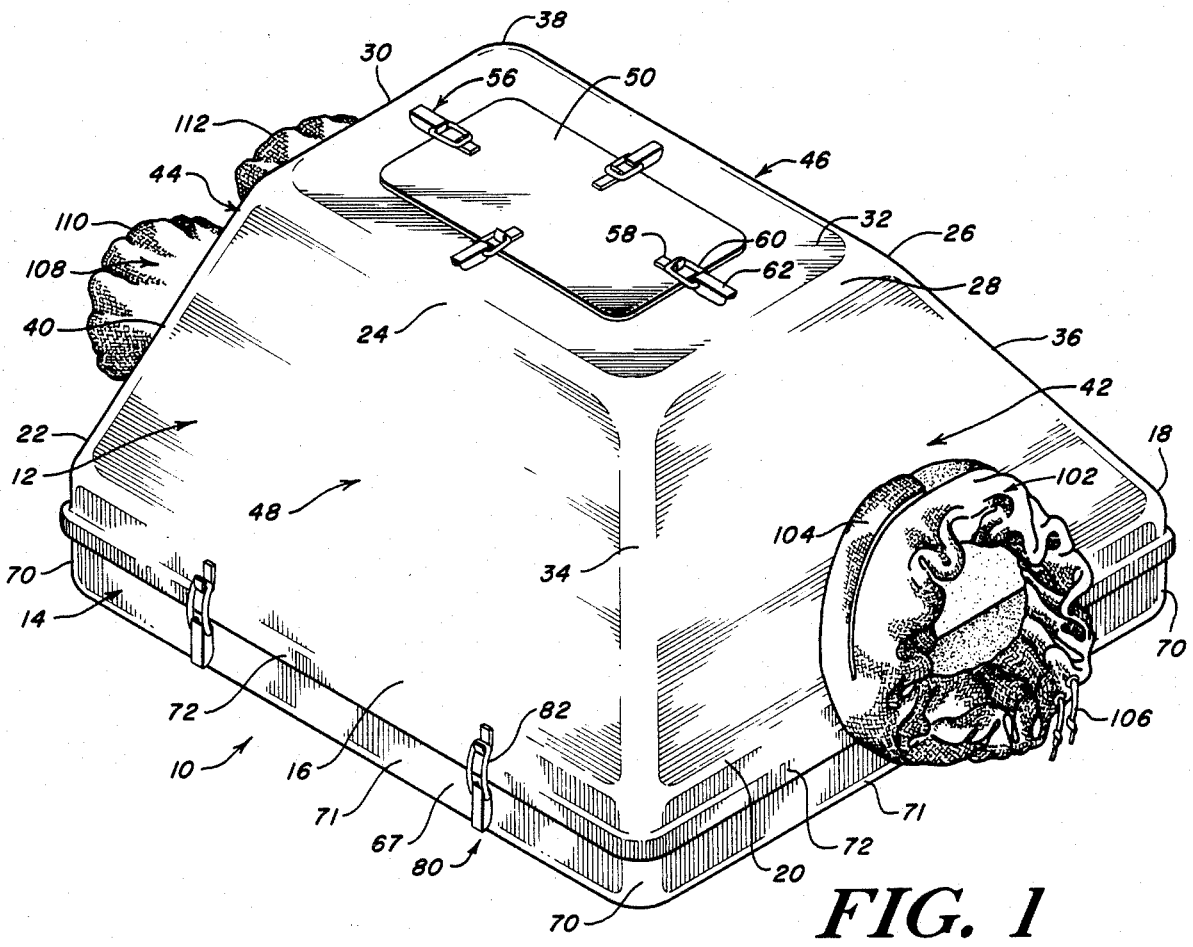
FIG. 1 is a front and to the side isometric view of the novel lightweight body respirator having flexible walls according the present invention.
Figure 2:
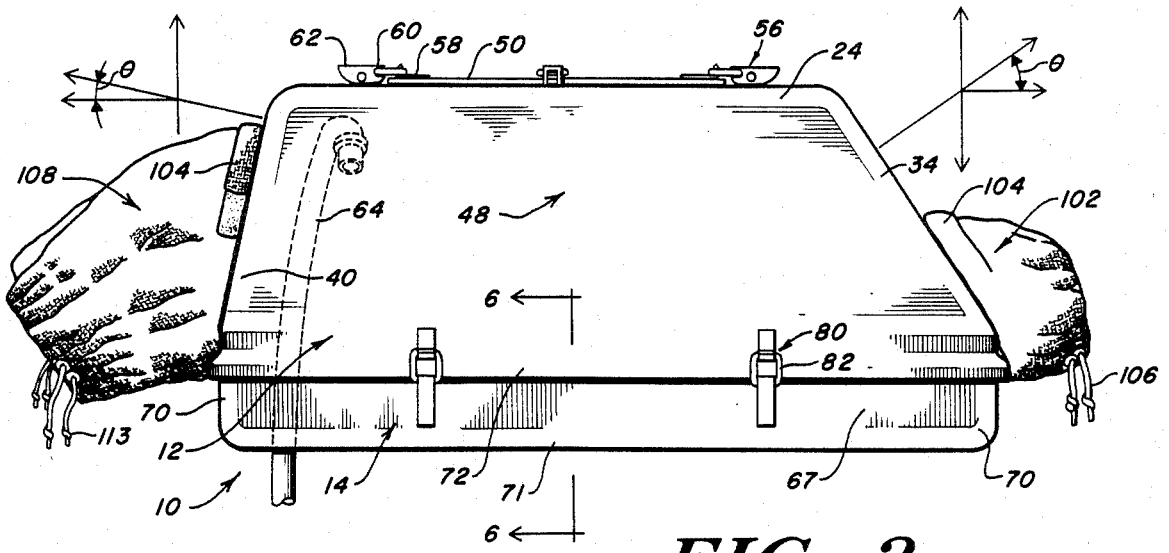
FIG. 2 is a side elevational view of the lightweight body respirator having flexible walls of the present invention.

Refering now to FIGS. 1 and 2, generally designated at 10 is the novel lightweight body respirator having flexible walls according to the present invention. The respirator 10 includes an integral molded-thermoplastic cover member generally designated 12 that is removably attached in air-tight sealing engagement with an integral molded-thermoplastic base member generally designated 14 defining therebetween a respirator cavity having an interior volume adapted to comfortably accept either the torso of an adult of the entire body of a child.

Arcuate side support ribs 16, 18 are integrally formed adjacent the bottom of the cover member 12 one to each side thereof, and arcuate end support ribs 20, 22 are integrally formed adjacent the bottom of the cover member 12 one to each end thereof. The bottom support ribs 16, 18, 20 and 22 define an open, generally rectangular bottom having a predetermined area.

Arcuate side support ribs 24, 26 are integrally formed at the top of the cover member 12 one to each side thereof, and arcuate end support ribs 28, 30 are integrally formed at the top of the cover member 12 one to each end thereof. The top support ribs 24, 26, 28, and 30 define a substantially planar top surface 32 having a predetermined area that is comparatively smaller than the area defined by the open, generally rectangular bottom of the cover 12.

A vertically inclined arcuate support rib 34 is integrally formed between the corner point of the bottom support ribs 16, 20 and the confronting corner point of the top support ribs 24, 28. A vertically inclined arcuate support rib 36 is integrally formed between the corner point of the bottom support ribs 20, 18 and the confronting corner point of the top support ribs 28, 26. A vertically inclined arcuate support rib 38 is integrally formed between the corner point of the bottom support ribs 18, 22, and the confronting corner point of the top support ribs 30, 26. A vertically inclined arcuate support rib 40 is integrally formed between the corner point of the bottom support ribs 22, 16, and the confronting corner point of the top support ribs 30, 24.

A flexible end wall generally designated 42 is integrally formed with the cover 12 between the ribs 34, 20, 36, and 28. As shown in FIG. 2, the normal to the plane defined by the integral flexible end wall 42 intersects the normal to a vertical plane at a preselected acute angle. A flexible end wall generally designated 44 is integrally formed with the cover 12 between the ribs 22, 40, 30, and 38. The normal to the plane defined by the flexible end wall 44 intersects the normal to a vertical plane at a preselected acute angle. As illustrated, the angle is preferably greater than the angle. A flexible sidewall generally designated 46 is integrally formed with the cover 12 between the ribs 18, 36, 26, and 38. A flexible sidewall generally designated 48 is integrally formed between the ribs 40, 16, 34, and 24. Preferably the angles defined by the normals to corresponding ones of the planar surfaces of the walls 46, 48, and the normal to a vertical plane, are equal to a preselected non-zero acute angle.

Figure 5:
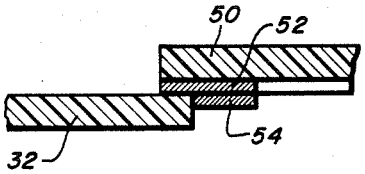
FIG. 5 is a fragmentary sectional view taken along the lines 5—5 of FIG. 4.

A molded-thermoplastic substantially planar patient access hatch 50 is removably attached in a central aperture provided therefor in the top 32 of the cover member 12. As can be seen in FIG. 5, a gasket 52 is fastened to the perimeter of the bottom surface of the hatch 50 to provide an air-tight seal between the hatch 50 and the confronting wall of the top 32, and a flange 54 is fastened to the gasket 52 having outside peripheral dimensions selected to be just less than the inside peripheral dimensions of the central aperture in the top 32 to provide an abutment surface to facilitate the alignment of the hatch 50 in the central opening. Latches generally designated 56 are provided for removably retaining the hatch 50 in air-tight sealing engagement with the top 32. The latches 56 preferably include U-shaped hooks 58 threadably fastened at spaced-apart points peripherally around the hatch 50, and cooperative elongated eyes 60 journaled in arms 62 that are pivotably fastened at spaced-apart points to the top 32.

Figure 3:
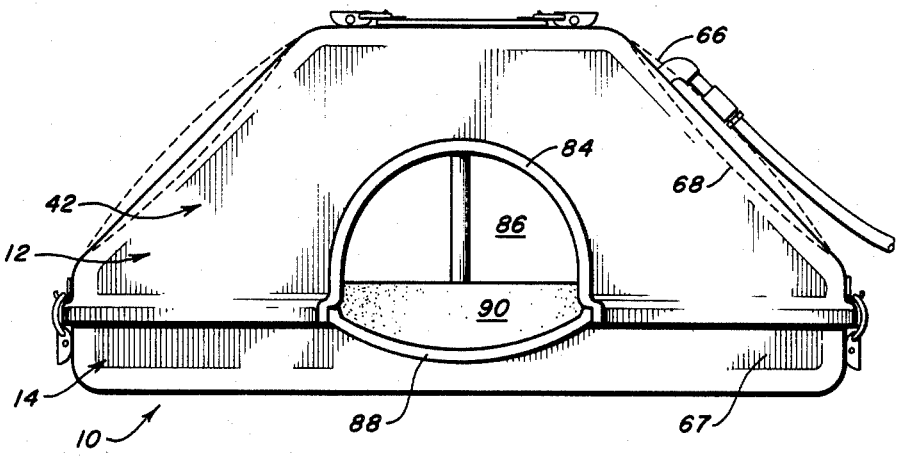
FIG. 3 is an end elevational view of the lightweight body respirator having flexible walls of the present invention.

A pump, not shown, is connected via a hose 64 to the respirator cavity. It will be appreciated that the pump controllably varies the air pressure in the respirator cavity in the usual manner to effect respiration of a patient afflicted with a neuromuscular breathing disorder. As illustrated in FIG. 3, the pressure variations introduced into the cavity of the respirator 10 effect an outward bowing illustrated by a dashed line 66, and an inward bowing illustrated by a dashed line 68, of the flexible walls of the cover member 12 during operation of the pump.

The base member 14 includes four integral upstanding walls 67 closed on themselves to form an open rectanguloid box. The top of the rectanguloid box defines a predetermined area that is substantially identical with the predetermined area defined by the open generally rectangular bottom of the cover member 12 such that when the members 12, 14 are joined, they mate in close-fitting relationship. Four upstanding arcuate corner support ribs 70, and four arcuate bottom support ribs 71 are integrally provided on the base member 14 for providing structural support therefor. The base member defines a conformal mattress receiving cavity between its upstanding walls.

Figure 6:
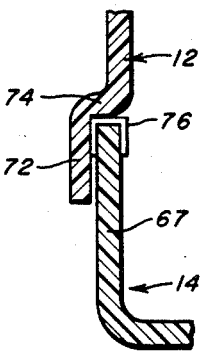
FIG. 6 is a sectional view taken along the lines 6—6 of FIG. 2.
Figure 7:
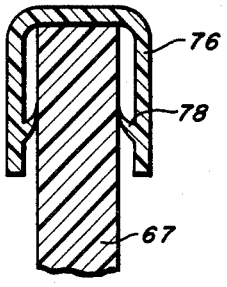
FIG. 7 is a detailed and enlarged schematic view illustrating the bracketed region in FIG. 6.

A downwardly depending sealing lip 72 having inside peripheral dimensions selected to be just larger than the outside peripheral dimensions of the upstanding walls 67 of the bottom member 14 is integrally formed at the bottom of the cover member 12. As best seen in FIG. 6, the downwardly extending peripheral sealing lip 72 is integrally formed on a laterally outwardly extending peripheral flange 74 that is integrally formed with the thermoplastic cover 12. A U-shaped resilient gasket 76 is positioned along the peripheral surface of the top of the upstanding walls 67 of the base member 14 for providing a seal between the cover member 12 and the base member 14. As illustrated in FIG. 7, the U-shaped resilient gasket 76 includes barbs 78 that engage the confronting surfaces of the upstanding walls 67 and frictionally retain the gasket 76.

Figure 8:
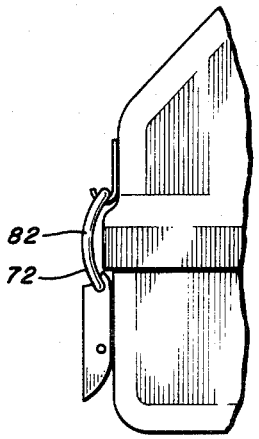
FIG. 8 is a detailed end elevational view of the latch mechanism of the lightweight respirator having flexible walls according to the present invention.

Latches generally designated 80 are provided for removably attaching the cover member 12 to the base member 14. It is noted that the latches 80 are substantially identical to the latches 56 except that the elongated eyes 82 thereof are arcuate to provide a clearance into which the peripheral sealing lip 72 is received as can best be seen in FIG. 8.

The flexible end face 42 is provided with a central longitudinally extending flange 84 having a generally semi-circular cross-section that defines a central opening 86 in the wall 42, as shown in FIG. 3. The adjacent wall 67 of the base member 14 is provided with a central longitudinally extending flange 88 having a generally arcuate cross-section that defines an opening 90 in the wall 67. The openings 86, 90 are cooperative to provide a neck receiving aperture through one of the end walls of the respirator 10.

Figure 4:
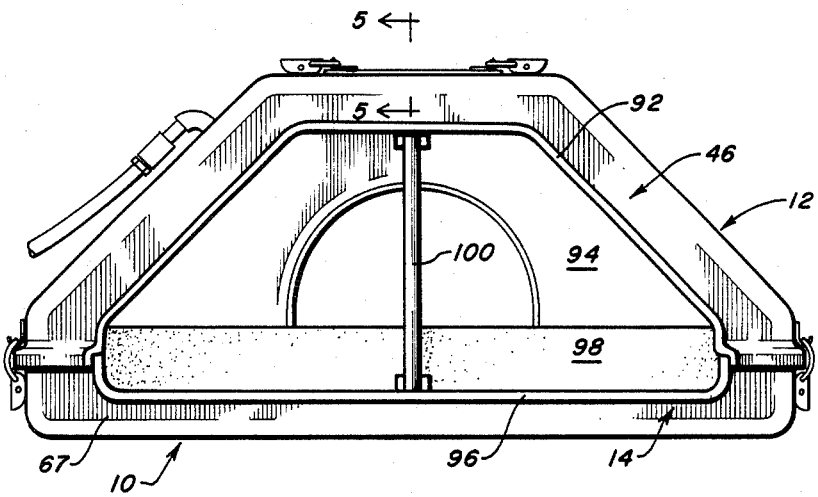
FIG. 4 is an end elevational view of the other end of the lightweight body respirator having flexible walls of the present invention.

The flexible end wall 46 of the cover member 12 is provided with a longitudinally extending flange 92 having a generally trapezoidal-shaped cross-section that defines an opening 94 in the end wall 46, as shown in FIG. 4. The adjacent upstanding wall 67 of the base member 14 is provided with a central longitudinally extending flange 96 having a generally U-shaped cross-section that defines an opening 98. The openings 94, 98 are cooperative to provide a waist/leg receiving aperture in the other end of the respirator 10. A vertical post 100 is centrally fastened in the waist/leg receiving aperture to prevent the distortion of the flexible end wall 46.

Figure 9:
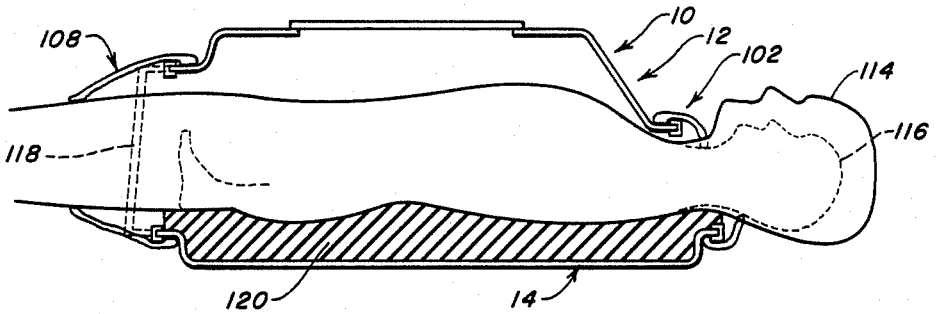
FIG. 9 is a sectional view illustrating another embodiment of the lightweight respirator having flexible walls according to the present invention.

An elongated collar generally designated 102 of any suitable flexible air-tight material is slideably mounted on the cooperative flanges 84, 88 at one end of the respirator. The collar 102 is provided on one end with complimentary VELCRO fasteners 104 or other suitable means for removably attaching it to the end of the respirator, and is provided on its other end with drawstrings 106 or other suitable means for adapting to variable patient neck sizes. A leg receiving girdle generally designated 108 is slideably mounted on the cooperative flanges 92, 96 provided on the other end of the respirator. The girdle 108 is preferably fashioned from the same flexible and air-tight material as the collar 102. The girdle 108 is provided on one of its ends with complimentary VELCRO fasteners 109 or other suitable means for removably attaching it to the longitudinally extending flanges 92, 96, and is provided on its other end with left and right leg receiving adjustable collars 110 and 112 having drawstrings 113 or other suitable means for providing an air-tight seal for the left and the right legs of a patient. As shown in FIG. 9, in the case of an adult patient designated 114, the legs extend through the girdle 108 in air-tight sealing engagement therewith at one end of the respirator 10. In the case of a child patient designated by the dash line 116, a wall shown dashed at 118 can be integraly provided in the cover member 12 thereby eliminating the leg receiving girdle 108. The patient is illustrated in the supine position, well-adapted for night ventilation and is supported by a conformal resilient mattress 120 inserted in the base member 14. A pillow, not shown, may be provided under the head of the patient.

What is claimed is:

1. A lightweight body respirator having flexible walls, comprising:

an integral molded-thermoplastic cover member having an open, substantially rectangular, bottom portion defining vertices and a first preselected cross-sectional area, a vertically spaced substantially planar top portion defining vertices and a second preselected cross-sectional area substantially less than said first cross-sectional area, a vertically inclined support rib extending from each of the vertices of the bottom portion to the corresponding confronting vertice of the top portion, and an integral sloping flexible wall extending between adjacent support ribs and defining a bottom end;

an integral molded-thermoplastic base member having upstanding walls having top ends closed on themselves defining an open rectanguloid box having a preselected cross-sectional area selected to be substantially equal to said cross-sectional area of said bottom portion of said cover member and defining a conformal mattress receiving cavity;

one of said sloping flexible walls of said cover member having a passage therethrough formed along its bottom end;

a first longitudinally extending flange integrally formed on said one of said sloping flexible walls of said cover member peripherally around said passage of said cover member;

one of said upstanding walls of said base member that confronts said one of said sloping walls of said cover member having a passage therethrough formed along its top end;

a second longitudinally extending flange formed on said one of the upstanding walls of said base member peripherally around said passage of said base member;

said first and second longitudinally extending flanges being mateable such that said passages are cooperative to provide a neck receiving aperture;

a flexible, elongated, adjustable, air-tight collar slideably mounted in air-tight sealing engagement peripherally around said first and second longitudinally extending flanges; and means for removably attaching said cover member and said base member in air-tight sealing engagement.

2. The invention of claim 1, wherein said support ribs are arcuate.

3. The invention of claim 1, further including longitudinally and transversely extending support ribs formed integrally adjacent said bottom of said cover member, and longitudinally and transversely extending support ribs formed integrally adjacent said top of said cover member.

4. The invention of claim 3, wherein said longitudinally and transversely extending support ribs are arcuate.

5. The invention of claim 1, wherein said top of said cover member has an opening therethrough, and further including a patient access hatch and means for removably retaining said hatch in said aperture provided therefor in air-tight sealing relationship.

6. The invention of claim 1, further including a conformal resilient mattress disposed in said cavity.

7. The invention of claim 1, wherein said first longitudinally extending flange has a semi-circular cross-section.

8. The invention of claim 7, wherein said second longitudinally extending flange has an arcuate cross-section.

9. The invention of claim 1, further including means for removably fastening said adjustable collar to said cooperative first and second flanges.

10. The invention of claim 9, wherein said collar fastening means includes complimentary VELCRO strips.

11. The invention of claim 1, further including a third longitudinally extending flange integrally formed on the flexible sloping wall opposite said sloping flexible wall upon which said first flange is formed, and a fourth longitudinally extening flange integrally formed on the adjacent upstanding wall of the base member that confronts the upstanding sidewall upon which said third flange is integrally formed, said third and said fourth longitudinally extending flanges cooperative to provide a waist/leg receiving aperture, and further including a flexible, elongated girdle having left and right leg receiving adjustable collars slideably mounted peripherally in air-tight sealing relation around said leg receiving aperture provided by said third and said fourth flanges.

12. The invention of claim 1, wherein said removable fastening means includes a peripheral sealing lip formed upon said bottom portion of said cover member.

13. The invention of claim 12, wherein said removable fastening means further includes latches respectively fastened between said cover member and said base member.

14. A lightweight body respirator having flexible walls, comprising:

a housing defining a body respirator cavity capable of accepting at least the chest, the arms, and the abdomen of a patient to be respirated;

said housing including a monolithic molded-thermoplastic cover member having planar first and second flexible sidewalls, planar first and second end walls, a generally horizontal and planar flexible top wall having an aperture therethrough, and an open rectangular bottom , said first sidewall intersects said first end wall along a first edge, said first end wall intersects said second sidewall along a second edge, said second sidewall intersects said second end wall along a third edge, and said second end wall intersects said first side wall along a fourth edge;

said first, second, third, and fourth edges each including an integral strength support rib integrally formed with said monolithic cover member;

a patient access hatch;

means for removably fastening said patient access hatch in said aperture in said top member;

said housing including a monolithic molded-thermoplastic base member having upstanding first and second planar sidewalls integrally formed with upstanding first and second planar end walls to provide a box having an open top having a preselected perimeter, said box defining a conformal mattress receiving cavity;

said preselected perimeter of said open bottom of said cover member and said preselected perimeter of said base member being selected such that said open top and said open bottom mate in overlapping sealing relation;

an elongated and flexible neck receiving collar, said collar including means for providing an adjustable air-tight seal for various neck sizes;

means including a housing opening defined by said first end walls of said cover and base members for mounting said neck receiving collar to said housing in air-tight sealing engagement therewith and in communication with said respirator cavity through said opening.

15. The invention of claim 14, further including an elongated and flexible leg receiving girdle having a left leg and a right leg receiving adjustable collar, and means defined by said second end walls of said cover and base members for removably fastening said girdle to said housing in air-tight sealing engagement.

16. The invention of claim 15, wherein said girdle fastening means includes complimentary VELCRO strips.

17. The invention of claim 14, wherein said sidewalls are sloping.

18. The invention of claim 14, wherein said endwalls are sloping.

* * * * *

UNITED STATES PATENT AND TRADEMARK OFFICE

CERTIFICATE OF CORRECTION

PATENT NO. : 4,523,579

DATED : June 18, 1985

INVENTOR(S) : Edward R. Barry

It is certified that error appears in the above-identified patent and that said Letters Patent is hereby corrected as shown below:

Column 1, line 61, "exending" should read --extending--

Column 2, line 40, "exemplarly" should read --exemplary--

Column 3, line 4, "Refering" should read --Referring--
line 13, "of the entire" should read --or the entire--
line 49, "acute angle." should read --acute angle θ.--
line 54, "angle." should read --angle θ.--
line 54, "angle is" should read --right hand angle θ is--
line 55, "angle." should read --left hand angle θ.--

Column 5, line 42, "integraly" should read --integrally--

Column 6, line 62, "extening" should read --extending--

Signed and Sealed this

Twenty-third Day of December, 1986

*Attest:*

DONALD J. QUIGG

*Attesting Officer* *Commissioner of Patents and Trademarks*